United States Patent [19]

Papasideris

[11] 4,338,896

[45] Jul. 13, 1982

[54] FIRE SUPPRESSION SYSTEM

[75] Inventor: Stamos I. Papasideris, Bristol, Ill.

[73] Assignee: Caterpillar Tractor Co., Peoria, Ill.

[21] Appl. No.: 195,720

[22] PCT Filed: Mar. 13, 1980

[86] PCT No.: PCT/US80/00267

§ 371 Date: Mar. 13, 1980

§ 102(e) Date: Mar. 13, 1980

[87] PCT Pub. No.: WO81/02609

PCT Pub. Date: Sep. 17, 1981

[51] Int. Cl.³ ..... F02B 77/00

[52] U.S. Cl. ..... 123/198 D; 123/198 DB

[58] Field of Search ..... 123/198 D, 198 DB, 196 S, 123/397, 479

[56] References Cited

U.S. PATENT DOCUMENTS 3,763,397 10/1973 Yockers ..... 123/198 D X
3,893,108 7/1975 McBride, Jr. et al. .... 123/198 D X
4,019,489 4/1977 Cartmill ..... 123/198 D X
4,150,654 4/1979 Heitzman et al. ..... 123/198 D X
4,160,916 7/1979 Papasideris ..... 123/198 D X

*Primary Examiner*—Tony M. Argenbright
*Attorney, Agent, or Firm*—Phillips, Moore, Weissenberger, Lempio & Majestic

[57] ABSTRACT

A fire suppression system (10) for a vehicle having an engine (11) and a fire extinguisher (36) located proximate thereto. Previous systems of this type have not given any positive indication to the vehicle operator of the presence of an engine fire and have allowed the operator to remain in the cab (23) of the vehicle. In the present invention, operation of the fire extinguisher (36) automatically causes actuating means (25 or 32) and flow-interrupting means (14 or 19) to cut off fuel flow to the engine (11) and automatically causes the vehicle horn (34) to sound a warning of variable intensity. The horn warning can only be terminated by opening a disconnect switch (22) located outside of the vehicle cab (23), so that the vehicle operator is required to leave the cab (23) to restore the horn (34) to normal operation.

13 Claims, 1 Drawing Figure

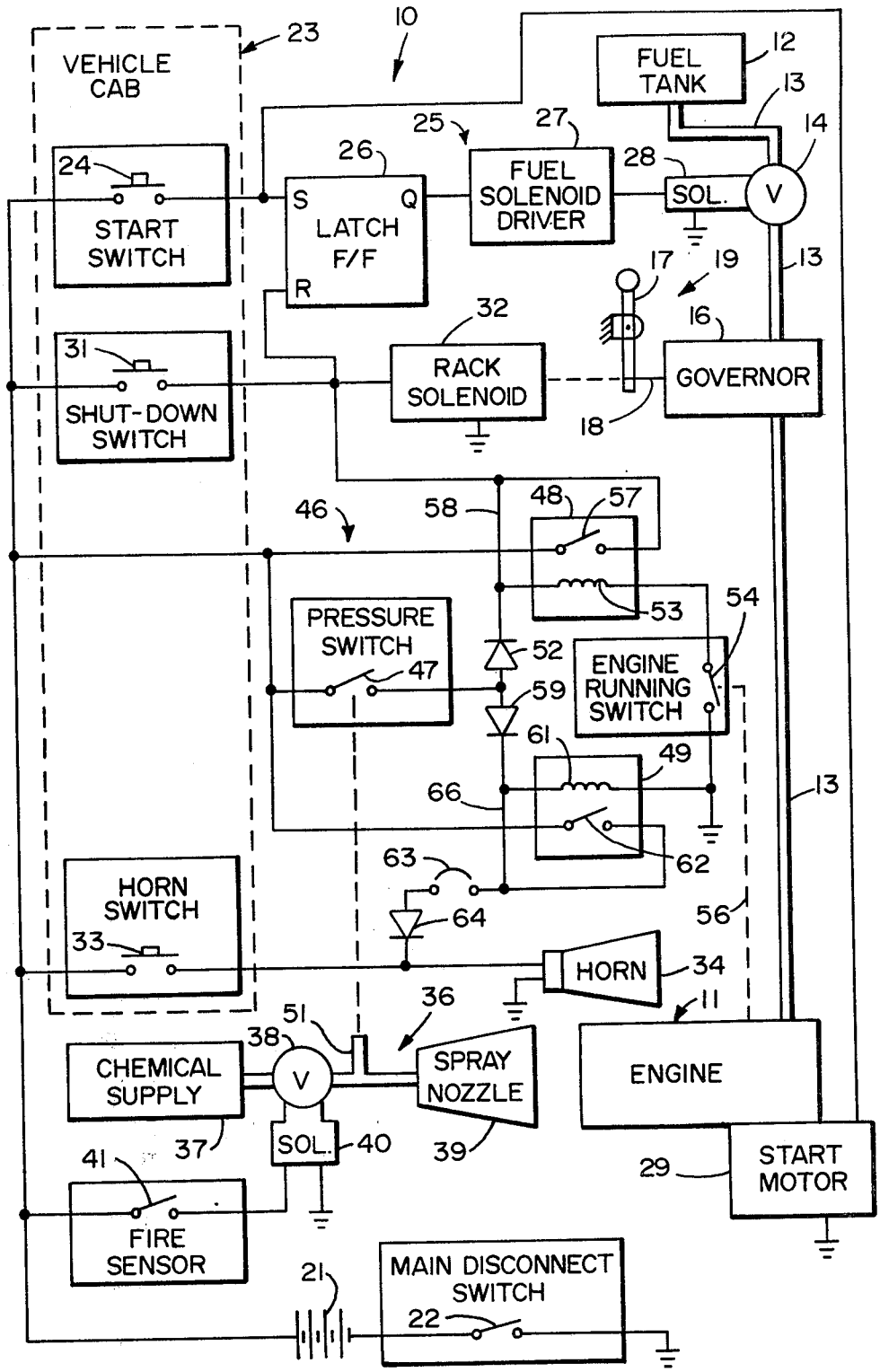
10
23
VEHICLE CAB
24
START SWITCH
31
SHUT-DOWN SWITCH
26
S
Q
LATCH F/F
R
25
27
FUEL SOLENOID DRIVER
28
SOL.
V
12
FUEL TANK
13
14
17
19
16
GOVERNOR
18
32
RACK SOLENOID
46
58
48
57
53
54
PRESSURE SWITCH
47
52
59
ENGINE RUNNING SWITCH
61
49
66
62
63
64
56
HORN SWITCH
33
HORN
34
36
51
38
CHEMICAL SUPPLY
37
SPRAY NOZZLE
39
SOL.
40
41
FIRE SENSOR
11
ENGINE
29
START MOTOR
21
MAIN DISCONNECT SWITCH
22

FIRE SUPPRESSION SYSTEM

DESCRIPTION

1. Technical Field

This invention relates to fire suppression systems for vehicles wherein a fire extinguisher is located in and used to extinguish fires occurring in the engine compartment of the vehicle and more particularly to a system which will automatically shut down the engine in the event of a fire, which will alert the operator of the existence of a fire and which will urge the operator to leave the vehicle cab.

2. Background of the Invention

Many vehicles, particularly large industrial trucks, earth-moving apparatus and the like, are equipped with fire extinguishers mounted in the engine compartment and which are actuable to put out an engine fire, if one should occur.

In the event of a fire, the fire suppression system must, of course, be activated to extinguish the fire. The engine must be shut down so that flow of fuel to the engine is stopped. Further, for his safety, the operator should get out of the cab of the vehicle.

Many present fire suppression systems are manually operable and require attention and affirmative action on the part of the vehicle operator. First, the operator must be aware that an engine fire is occurring. In many vehicles the engine compartment is rearward of the vehicle cab and out of the normal line of sight of the operator. In such vehicles, the operator may not become aware of an engine fire until considerably after the time it started. Upon becoming aware of a fire, the operator must then press the appropriate emergency button to put the fire extinguisher into operation, and must take affirmative action to shut down the engine and fuel flow.

Other present fire suppression systems are provided with some sort of a fire sensor in the engine compartment which will sense the presence of a fire and turn on the fire extinguisher automatically. Such systems still require the vehicle operator to be aware that a fire is occurring so that he can affirmatively shut down the engine.

Improvements in fire suppression systems have been devised wherein the presence of a fire is sensed and in automatic response thereto the fire extinguisher is turned on and the engine is shut down. The vehicle operator will, of course, notice that the engine has shut down. However, such systems still present problems. Since engine failure can occur from a variety of reasons, the operator may not notice that an engine fire is occurring and may think the engine has stopped for some other reason. In such case, he may not realize that he should follow the normal safety procedure of leaving the cab. Further, such improved systems allow the operator to restart the engine after the fire has been extinguished. Thus, even though the operator may in fact be aware of the fire, he might feel that the inconvenience of leaving the cab was more important to him that the potential danger of staying inside. If so, he could ignore the normal safety procedures and remain in the cab, waiting for the fire to be put out so that he could resume normal vehicular activity.

DISCLOSURE OF INVENTION

The present invention is directed to overcoming one or more of the problems as set forth above.

In one aspect of the invention this is accomplished in a vehicle having an engine, a fuel tank, a fuel line from the fuel tank to the engine, a flow-interrupting means in the fuel line, an actuator for the flow-interrupting means, a fire extinguisher located proximate to the engine, and a battery, by providing a warning device and means for automatically connecting both the actuator for the flow-interrupting means and the warning device to the battery in response to operation of the fire extinguisher so that the fuel to the engine is cut off and a warning is given.

A further aspect of the invention is that the warning device is connected to the battery through a manually-operable disconnect switch outside of the vehicle cab, so that when once started, the warning device will continue in operation until the disconnect switch is opened.

Another aspect of the invention is that the audible warning device is the vehicle horn and that the audible warning of the horn differs from a normal malfunction of the horn.

The foregoing and other aspects will become apparent from the following detailed description of the invention when considered in conjunction with the accompanying drawing.

BRIEF DESCRIPTION OF THE DRAWING

The single FIGURE is a schematic view illustrating a fire suppression system embodiment of the present invention.

BEST MODE FOR CARRYING OUT THE INVENTION

The drawing illustrates schematically a fire suppression system 10 for a vehicle having an engine 11, a fuel tank 12, and a fuel line 13 from the fuel tank to the engine. Typically, a flow-interrupting means 14, shown herein as a normally-closed valve, is provided in the fuel line 13 near the fuel tank. Also typically, a governor 16 is connected in the fuel line 13 near the engine 11. With valve 14 open, the vehicle operator can control the flow of fuel to the engine 11 and the engine speed by throttle lever 17 which is connected to the fuel rack linkage 18 of the governor 16. The engine 11 is normally shut down by the operator by movement of the throttle lever 17 to fuel-off position, such movement causing the fuel rack linkage 18 to move to a position cutting off the flow of fuel through governor 16 to engine 11. For purposes of definition, the governor 16 and its associated throttle lever 17 and fuel rack linkage 18 constitute a flow-interrupting means 19, and either the flow-interrupting means 14 or the flow-interrupting means 19 can function to shut off flow of fuel from fuel tank 12 to engine 11.

The electrical system for the vehicle includes a battery 21 and a manually-operable main disconnect switch 22 connected in series with the battery. The battery 21 and disconnect switch 22 will be located on the vehicle outside of and away from vehicle cab 23.

Typically, a manually-operable start switch 24 is provided in the vehicle cab 23, so that the operator can cause the actuating means 25 to actuate fuel valve 14 to open position. As shown herein, closure of start switch 24 will apply voltage to the set input S of the latch or flip-flop, 26, causing its Q output to go high. The high Q output is applied to the fuel solenoid driver 27 and fuel solenoid 28 will be energized to cause valve 14 to open. Closure of start switch 24 will also apply voltage to start motor 29 which will crank engine 11. When engine 11 begins running, start switch 24 is opened to remove power from start motor 29. Flip-flop 26 will remain set and fuel valve 14 will be maintained open.

Also typically, a manually-operable shut-down switch 31 is provided in the vehicle cab. Movement of shut-down switch 31 to its closed, or shut-down, position will energize actuating means 32, herein shown as a solenoid physically connected to throttle lever 17 and fuel rack linkage 18, to actuate flow-interrupting means 19 to shut off fuel flow through fuel line 13. Closure of shut-down switch 31 will also apply voltage to the reset input R of flip-flop 26, causing its Q output to go low so that valve 14 will close to shut off fuel flow from fuel tank 12.

Further typically, a manually-operable horn switch 33 is provided in vehicle cab 23 so that the vehicle operator can cause the warning device 34, herein shown as a horn, to operate when horn switch 33 is closed.

A fire extinguisher 36 is located in the engine compartment of the vehicle proximate to engine 11, the fire extinguisher 36 comprising a tank 37 filled with a suitable chemical under pressure, a valve 38 and spray nozzle 39. Preferably, valve 38 has a solenoid operator 40 for remote control of the fire extinguisher, and, as shown here, solenoid 40 is connectable to battery 21 by means of a fire-sensor switch 41. As is apparent, if there is a fire in the engine compartment, presence of such fire will be sensed, switch 41 will close automatically and the energized solenoid 40 will open valve 38 to release the pressurized chemical through spray nozzle 39.

In accordance with the present invention, a connecting means 46 is provided for connecting the actuating means 25 and 32 to battery 21 other than through the shut-down switch means 31 in response to operation of the fire extinguisher 36, and for connecting the horn 34 to battery 21 other than through the horn switch means 33 in response to operation of the fire extinguisher 36.

In the embodiment of the invention shown in the drawing, connecting means 46 includes pressure switch 47, first and second relays 48 and 49, and the hereinafter described elements associated therewith.

When fire extinguisher 36 is put into operation, valve 38 thereof will open, applying pressure to conduit 51 which will cause the normally-open pressure switch 47 to close. Such closure will apply battery voltage through pressure switch 47 and isolation diode 52 to relay coil 53 of the first relay 48. With the engine 11 running, engine-running switch 54 will be closed, so that relay coil 53 will be energized by closure of the pressure switch 47. (The engine-running switch 54 is responsive to some condition that exists only when the engine is in operation. For example switch 54 can be responsive, indicated by the dotted response line 56, to oil pressure in the engine, with switch 54 being open or closed depending upon whether the oil pressure in below or above a predetermined value.)

Energization of relay coil 53 will close the relay switch 57 of first relay 48. Since relay switch 57 is in parallel with the shut-down switch 31, closure of relay switch 57 will apply voltage to the rack solenoid 32 and the reset input R of flip-flop 26, in the same manner and causing the same results as if shut-down switch 31 had been closed by the operator.

The first relay 48 is wired, at 58, to provide a latching means for connecting relay coil 53 through relay switch 57 to the battery, so that relay coil 53 is maintained energized even though pressure switch 47 may open prior to the shutting down of engine 11.

Rack solenoid 32 is typically a heavy-duty, high-current drain solenoid and it is desirable to deenergize the rack solenoid as soon as the engine 11 has been shut down. As shown here, when engine 11 ceases running, engine-running switch 54 will open to deenergize relay coil 53. In turn, relay switch 57 will open to deenergize the rack solenoid 32. The fuel-shut off valve 14 will remain closed until such time as the operator again causes voltage to be applied to the set input S of flip-flop 26.

Closure of pressure switch 47 will also apply battery voltage through isolation diode 59 to relay coil 61 of the second relay 49. Energization of relay coil 61 closes relay switch 62 so that battery voltage is applied to horn 34 through relay switch 62, flasher 63 (which serves as a means for cyclically varying the voltage applied to horn 34 when the connecting means 46 is connecting the horn 34 to the battery 31) and isolation diode 64. As before, the second relay 49 is wired, at 66, to provide a latching means for connecting relay coil 61 through relay switch 62 to the battery so that the relay coil 61 is maintained energized even though pressure switch 47 may open. As a consequence, horn 34 will be repeatedly and intermittently energized for as long as the second relay 49 is latched with its relay coil 61 energized. In order to unlatch the second relay 49, the main disconnect switch 22 at battery 21 must be opened to interrupt the energizing circuit for relay coil 61. With relay coil 61 deenergized, relay switch 62 will open and normal control of horn 34 by the manually-operable horn switch 33 will be restored when the main disconnect switch 22 is thereafter closed.

INDUSTRIAL APPLICABILITY

The present invention is adapted for use in vehicles having a fire extinguisher mounted in the engine compartment. The connecting means 46 described herein can be installed as part of a fire suppression system in new equipment, or it can be easily added to an existing vehicle which already has a rack solenoid 32, horn 34 and fire extinguisher 36.

In any event, the connecting means 46 will function to shut down the engine by causing the governor 16 to interrupt the flow of fuel to the engine. (It will also cause valve 14 to shut off flow of fuel from the fuel tank 12.) In addition, the connecting means 46 will cause the horn 34 to sound, positively alerting the vehicle operator to the fact that there is an engine fire in case he was not aware of it.

Further, once the horn starts sounding, in response to operation of the fire extinguisher, it will continue to sound until the main disconnect switch 22 is opened. Since the main disconnect switch 22 is not in the vehicle cab, the vehicle operator must leave the cab in order to turn the horn off. Thus, even though a vehicle operator might otherwise be aware of an engine fire and might be tempted to stay in the cab and resume vehicle operation after the fire is out, such temptation will be largely removed since the operator will know that he has to get out of the cab anyway to shut off the horn.

Use of the intermittent circuit interrupter 63 in the horn circuit when a fire occurs also has an important advantage. As set forth above, if the fire extinguisher 36 goes into operation, the engine 11 will be automatically shut down and the horn energized. There is a possibility, particularly in off-the-road earthmoving operations, that the vehicle operator could think that a flying rock or the like had damaged the normal electrical circuits of the vehicle causing engine power to be lost and shorting the horn circuit. With the intermittent circuit interrupter 63 in operation in event of fire, the horn will be repeatedly turned on and off, and the operator will immediately realize that the horn circuit has not simply shorted (which would cause the horn to operate continuously) but that a true emergency condition exists.

Other aspects, objects and advantages of this invention can be obtained from a study of the drawings, the disclosure and the appended claims.

I claim:

1. An improvement in a fire suppression system (10) for a vehicle having an engine (11), a fuel tank (12), a fuel supply line (13) from said fuel tank 12 to said engine (11), flow-interrupting means (14 or 19) for shutting off flow of fuel through said flow line (13), a battery (21), a vehicle cab (23), a shut-down switch (31) located in said vehicle cab (23), said shut-down switch (31) being connected to said battery (21) and having a shut-down position, actuating means (25 or 32) for actuating said flow-interrupting means (14 or 19) to shut off flow of fuel through said fuel line (13) in response to movement of said shut-down switch (31) to its shut-down position, a manually-operable disconnect switch (22) connected in series with said battery (21) and located outside of said vehicle cab (23), and a fire extinguisher (36) located proximate to said engine (11), the improvement comprising:

a warning device (34), connecting means (46) for causing said actuating means (25 or 32) to actuate said flow-interrupting means (14 or 19) to shut off flow of fuel through said fuel line (13) in response to operation of said fire extinguisher (36) and without movement of said shut-down switch (31) to its shut-down position, and for connecting said warning device (34) to said battery (21) in response to operation of said fire extinguisher (36) with such connection of said warning device being maintained for as long as said disconnect switch is closed.

2. The improvement as set forth in claim 1, wherein said actuating means (32) requires connection to said battery (21) to actuate said flow-interrupting means (19) to shut off flow of fuel through said fuel line (13), wherein said connecting means (46) has the function of connecting said actuating means (32) to said battery (21) in response to operation of said fire extinguisher (36), and wherein said connecting means (46) includes an engine-running switch means (54) for maintaining a connection of said actuating means (32) to said battery (21) by said connecting means (46) while said engine (11) is running and for interrupting said connection of said actuating means (32) to said battery (21) after said engine (11) has stopped.

3. The improvement as set forth in claim 2, wherein said warning device (34) is an audible horn and further including a manually-operable horn switch (33) located in said vehicle cab (23) for connecting said horn (34) to said battery (21), and wherein said connecting means (46) has the function of connecting said horn (34) to said battery (21) other than through said manually operable horn switch (33).

4. The improvement as set forth in claim 3, wherein said connecting means (46) includes means (63) for cyclically varying the voltage applied to said horn (34) when said connecting means (46) is connecting said horn (34) to said battery (21).

5. The improvement as set forth in claim 1 wherein said warning device (34) is an audible horn and further including a manually-operable horn switch (33) for connecting said horn (34) to said battery (21), and wherein said connecting means (46) has the function of connecting said horn (34) to said battery other than through said manually-operable horn switch (33).

6. The improvement as set forth in claim 5 wherein said connecting means (46) includes means (63) for cyclically varying the voltage applied to said horn (34) when said connecting means (46) is connecting said horn (34) to said battery (21).

7. The improvement as set forth in claim, 5, wherein said actuating means (25 or 32) requires connection to said battery (21) to actuate said flow-interrupting means (14 or 19) to shut off flow of fuel through said fuel line (13), wherein said connecting means (46) includes a first relay (48) having a relay coil (53) and a relay switch (59) and a second relay (49) having a relay coil (61) and a relay switch (62), said relay switch (59) of said first relay (48) being connected in parallel with said shut-down switch (31), said relay switch (62) of said second relay (49) being connected in parallel with said horn switch (33), said connecting means (46) having the further function of connecting both relay coils (53,61) of said first and second relays (48,49) in series with said battery (21) and said disconnect switch (22) in response to operation of said fire extinguisher (36).

8. The improvement as set forth in claim 7, wherein said connecting means (46) further includes a first latching means (58) for connecting said first relay coil (53) through said first relay switch (59) to said battery (21) and a second latching means (66) for connecting said second relay coil (61) through said second relay switch (62) and said disconnect switch (22) to said battery (21).

9. The improvement as set forth in claim 8, wherein said connecting means (46) further includes an engine-running switch (54) in series with said first relay coil (53), said engine-running switch (54) being closed only when engine (11) is running.

10. The improvement as set forth in claim 9, wherein said connecting means (46) includes means (63) for cyclically varying the voltage applied through said second relay switch (62) to said horn (34).

11. A fire suppression system (10) for a vehicle comprising:

an engine (11), a fuel tank (12), a fuel supply line (13) from said fuel tank (12) to said engine (11), flow-interrupting means (14 or 19) for shutting off flow of fuel through said fuel line (13), a battery (21), a vehicle cab (23), a shut-down switch (31) located in said vehicle cab (23) and connected to said battery (21) and having a shut-down position, actuating means (25 or 32) for actuating said flow-interrupting means (14 or 19) to shut-off flow of fuel through said fuel line (13) in response to movement of said shut-down switch (31) to its shut down position, a manually-operable disconnect switch (22) connected in series with said battery (21) and located outside of said vehicle cab (23), a fire extinguisher located proximate to said engine (11), a horn (34), a horn switch (33) for connecting said horn (34) to said battery (21), connecting means (46) for causing said actuating means (25 or 32) to actuate said flow-interrupting means (14 or 19) to shut off flow of fuel through said fuel line (13) in response to operation of said fire extinguisher (36) and without movement of said shut-down switch (31) to its shut-down position, and for connecting said horn (34) to said battery (21) through said disconnect switch (22) in response to operation of said fire extinguisher and other than through said horn switch (33).

12. A fire suppression system (10) as set forth in claim 11, wherein said connecting means (46) includes means (63) for cyclically varying the voltage applied to said horn (34) when said connecting means (46) is connecting said horn (34) to said battery (21).

13. A fire suppression system (10), as set forth in claim 11 wherein said actuating means (32) requires connection to said battery (21) to actuate said flow-interrupting means (19) to shut-off flow of fuel through said fuel line (13), wherein said connecting means (46) has the function of connecting said actuating means (32) to said battery (21) in response to operation of said fire extinguisher (36), and wherein said connecting means (46) includes an engine-running switch means (54) for maintaining a connection of said actuating means (32) to said battery (21) by said connecting means (46) for only so long as said engine (11) is running.

* * * * *